United States Patent [19]

English et al.

[11] 4,169,238

[45] Sep. 25, 1979

[54] MOVIE LIGHT, LOW VOLTAGE INCANDESCENT LAMP UNIT FOR USE THEREWITH, AND REFLECTOR

[75] Inventors: George J. English, Reading; Robert E. Levin, South Hamilton, both of Mass.

[73] Assignee: GTE Sylvania Incorporated, Stamford, Conn.

[21] Appl. No.: 939,928

[22] Filed: Sep. 6, 1978

[51] Int. Cl.[2] ..... H01K 1/14; H01K 1/32

[52] U.S. Cl. ..... 313/1; 313/113; 313/116

[58] Field of Search ..... 313/111, 116, 113, 114, 313/115, 1; 362/346, 304, 297

[56] References Cited

U.S. PATENT DOCUMENTS

| | | | |
|---|---|---|---|
| 2,387,038 | 10/1945 | Owens | 362/346 X |
| 2,411,568 | 11/1946 | Foote | 313/1 X |
| 2,810,660 | 10/1957 | Carpenter | 313/113 X |
| 4,021,659 | 5/1977 | Wiley | 362/297 |

*Primary Examiner*—Palmer C. Demeo

*Attorney, Agent, or Firm*—Lawrence R. Fraley

[57] ABSTRACT

A movie light including a plastic holder, a pair of spaced-apart incandescent lamp units positioned within the holder, and means for electrically connecting the lamp units to an external power source. Each lamp unit comprises a formed glass reflector which has an internal reflective surface containing three separate diffusing regions, the most diffusing of which is oriented nearest and about the reflector's optical axis. Each unit also includes a low voltage tungsten-halogen lamp located within the reflector and having a planar single filament therein. An incandescent lamp unit suitable for use in the movie light and a reflector for use therewith are also disclosed.

26 Claims, 7 Drawing Figures

MOVIE LIGHT, LOW VOLTAGE INCANDESCENT LAMP UNIT FOR USE THEREWITH, AND REFLECTOR

CROSS-REFERENCE TO RELATED APPLICATIONS

An application listed under Ser. No. 939,930 and assigned to the same assignee as the instant invention was filed concur rently herewith. In Ser. No. 939,930, there is described a high voltage e.g. 240 volt, movie light which utilizes a pair of lamp units, each including a planar, dual filament structure. The movie light produces a dual bimodal intensity distribution on a rectangular subject field located an established distance from the light.

BACKGROUND OF THE INVENTION

The invention relates to incandescent lamps generally, and with greater particularity to equipment which utilize such lamps to provide light for the production of motion pictures. Such equipment will hereinafter be referred to as "movie lights."

One of the latest developments in the motion picture field has been the "instant movie" system designed by the Polaroid Corporation, Cambridge, Massachusetts. This system includes an automatic-exposure movie camera in which a film-containing cassette is used. Exposure of the film occurs within the cassette which is inserted within a special projector, or "player" and the film projected on the player's screen. Processing of the film requires only about ninety seconds.

The present invention is especially adapted for utilization with the above movie system, in addition to other systems requiring similar levels of illumination. As will be described, the present invention is electrically operated and is fully capable of being mounted on a movie camera such as the above. Understandably, the function of the invention is to substantially uniformly illuminate a subject field located at a prescribed distance in front of the camera during periods of use in which normally satisfactory illumination is not otherwise available.

By uniformly illuminated is meant a corner-to-center illumination ratio within the range of about 0.32 to about 0.45 for a rectangular subject field located at a distance of approximately fifteen feet from the movie camera. That is, the center of the subject field at this distance requires a level of illumination of about two and one-half to three times the level needed for the corners of the field. A typical field is about fifty-eight inches (vertical) by seventy-eight inches (horizontal). A desired luminous intensity at the center of the field is within the range of about 14,500 to 17,000 candelas while that of the respective corners of the field is within the range of about 5,000 to 7,500 candelas.

Most known systems capable of providing the above illumination are relatively expensive to both operate and purchase as well as very awkward to operate when used in conjunction with movie cameras.

It is believed, therefore, that a movie lighting system which is compact, relatively, inexpensive, and capable of providing the above-desired levels of illumination would constitute an advancement in the art. It is further believed that a lamp unit capable of being used in such a system, and a reflector for use with said unit would also constitute advancements in the art.

OBJECTS AND SUMMARY OF THE INVENTION

It is, therefore, a primary object of the present invention to provide a movie light capable of providing the levels of uniform illumination defined above.

It is a further object of the invention to provide such a movie light which is compact, inexpensive, and capable of being readily mounted on a movie camera.

It is still another object of the invention to provide a lamp unit for use with the aforedescribed movie light.

Yet another object is to provide a reflector for use with the above lamp unit.

In accordance with one aspect of the invention, there is provided a movie light which comprises a holder, a pair of spaced-apart lamp units within the holder, and means for electrically connecting both units to an external power source. Each unit includes a reflector with a low voltage incandescent lamp positioned substantially therein. The internal diffusing surface of the reflector is divided into three regions of different diffusing characteristics.

In accordance with another aspect of the invention, there is provided a lamp unit which includes a low voltage incandescent lamp positioned within a reflector which has an internal diffusing surface divided into the aforedescribed three regions. The lamp includes a light-transmitting envelope with a planar filament located therein.

In accordance with yet another aspect of the invention, there is provided a reflector which is adapted for providing controlled diffusion of light. The reflector includes a concave diffusing surface with three diffusing regions, each located about the optical axis of the reflector and possessing different diffusing capabilities.

DETAILED DESCRIPTION OF THE PREFERRED EMBODIMENTS

For a better understanding of the present invention together with other and further objects, advantages and capabilities thereof, reference is made to the following disclosure and appended claims in connection with the above-described drawings.

Figure 1:
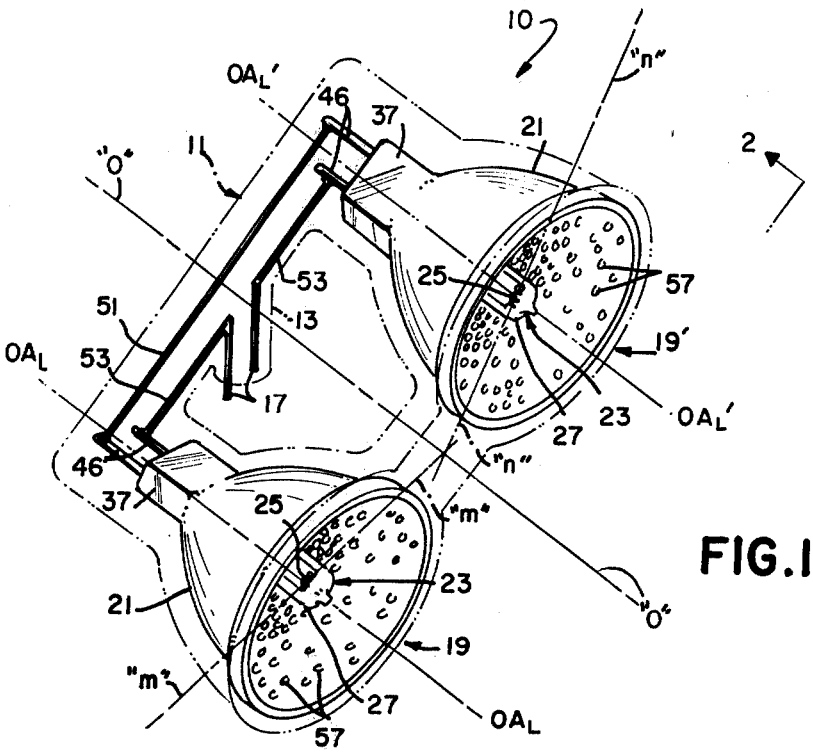
FIG. 1 is an isometric view of a movie light in accordance with a preferred embodiment of the invention.
Figure 2:
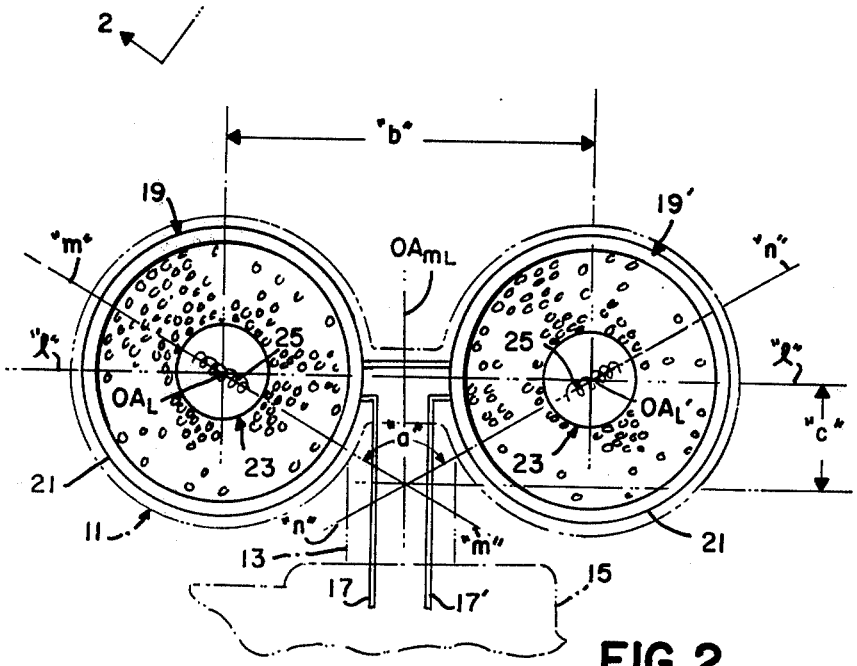
FIG. 2 is a front elevational view of the embodiment of FIG. 1 as taken along the line 2—2 in FIG. 1.

With particular reference to FIGS. 1 and 2, there is shown a movie light 10 in accordance with a preferred embodiment of the invention. Light 10 includes a holder 11 (shown in phantom for purposes of clarity) which includes a base portion 13 adapted for being mounted on a movie camera 15 (shown in phantom in FIG. 2) such as the previously described "instant movie" camera developed by the Polaroid Corporation. It is of course understood that light 10 is capable of being successfully used with other types of cameras, including conventional 8 mm, super-8, and 16 mm. systems, provided a suitable adapter is utilized. Housing 11 is of insulative material such as plastic. Base portion 13 includes a pair of projecting terminals 17 and 17' which connect to the lamp units 19 and 19' of light 10 in a manner to be described. Terminals 17 and 17' are adapted for being plugged into a corresponding socket located within camera 15 and electrically joined to the circuitry associated therewith. Accordingly, light 10 will be electrically connected to the same power source, e.g. conventional outlet, as the camera. If it is desired not to mount light 10 atop camera 15 as shown in FIG. 2, it is well within the scope of the invention to simply connect terminals 17, 17' to the above power source via other means, e.g. a suitable extension cord with a socket adapted to receive base 13.

Lamp units 19 an 19' are similar and each include a formed reflector 21 with a low voltage incandescent lamp 23 located therein. By low voltage is meant an operating voltage within the range of about 50 to 65 volts. Accordingly, light 10 operates at normal line voltage, e.g. within the range of 100 to 130 volts, when lamps 23 are joined in series. The invention is thereby ideally suited for connection to the standard house outlet. Each lamp 23 preferably has a rated wattage of about 85 watts, an average operational life of about 8 hours, and a lumen rating of approximately 2500 lumens.

Reflectors 21, preferably of borosilicate glass, are spaced apart from each other and secured within holder 11 such that the respective optical axes ($OA_L$–$OA_l$ and $OA_L'$–$OA_L'$) are parallel. These axes are also preferably located in the same plane "1"–"1" as the optical axis $OA_{ML}$ (FIG. 2) of light 10 and are parallel to said axis.

Lamps 23 are preferably of the tungsten-halogen variety. In tungsten-hologen lamps, the tungsten is normally evaporated from the filaments 25 during operation and combines with the halogen to form a gaseous halide, which prevents the tungsten from depositing on the internal wall of the lamp's envelope 27. Upon returning to the tungsten filaments 25, the halide decomposes, resulting in the deposition of tungsten back onto the filaments and the release of additional halogen gas to assure continuation of the cycle. The halogen cycle is well known in the incandescent lamp art, and lamps employing it have been on the market for some time.

In the present invention, each lamp contains a single filament 25 which is preferably a straight, helical coiled tungsten member transversely oriented on the optical axis of the respective reflector. As such, each filament is planar with the filament of lamp 19 occupying a first plane "m"–"m" and the filament of lamp 19' occupying a second plane "n"–"n". The planes "m"–"m" and "n"–"n" are not parallel but instead intersect along a line "0"–"0" which is parallel to the optical axis $OA_{ML}$ of light 10 and located at an established distance "c" below the axis when the light is positioned on camera 15 and the camera aimed at a subject field in the normal manner. At this time, axis "1"–"1" will lie horizontal in the manner illustrated in FIG. 2. As shown in FIG. 2, the parallel optical axes of reflector 2 are spaced apart the distance "b".

In accordance with a preferred embodiment of the invention, dimension "b" is about 2.75 inches, dimension "c" is 1.15 inches, and angle "a" is within the range of about 90 to about 110 degrees. Ideally, angle "a" is 100 degrees when light 10 is used to illuminate a rectangular subject field located fifteen feet from the light and having a height of about fifty-eight inches and a width of about seventy-eight inches. As such, the subject field has an aspect ratio of about 3:4 (height:width).

One of the key features of the instant invention is the unique ability to provide the subject field with the aforedefined levels of illumination with a minimal loss of light outside the field. These levels are deemed sufficient for exposing the film utilized in the described "instant movie" system. Such levels are of course also acceptable for the other motion picture camera systems mentioned. To provide this controlled diffusion of light, the reflectors 21 of the invention each include an internal, concave reflecting surface 29 which is generally circular in planes ("p") perpendicular to the reflector's optical axis $OA_L$—$OA_L$. Attention is called to FIG. 3 where one of the lamp units (19) of the invention is shown in cross-section. Surface 29 is divided into three adjoining diffusing regions 31, 33, and 35 which are oriented about the reflector's optical axis. Each region possesses different controlled diffusing capabilities than the others with the first region 31 being the most diffuse and region 35 the least diffuse. By controlled diffusion is meant adjusting, e.g. increasing, the angular spread of a bundle of light rays from an element of the reflecting surface by a defined amount. This is accomplished by maintaining the specularity of the reflecting surface and adjusting local optical power using techniques known in the art.

Figure 3:
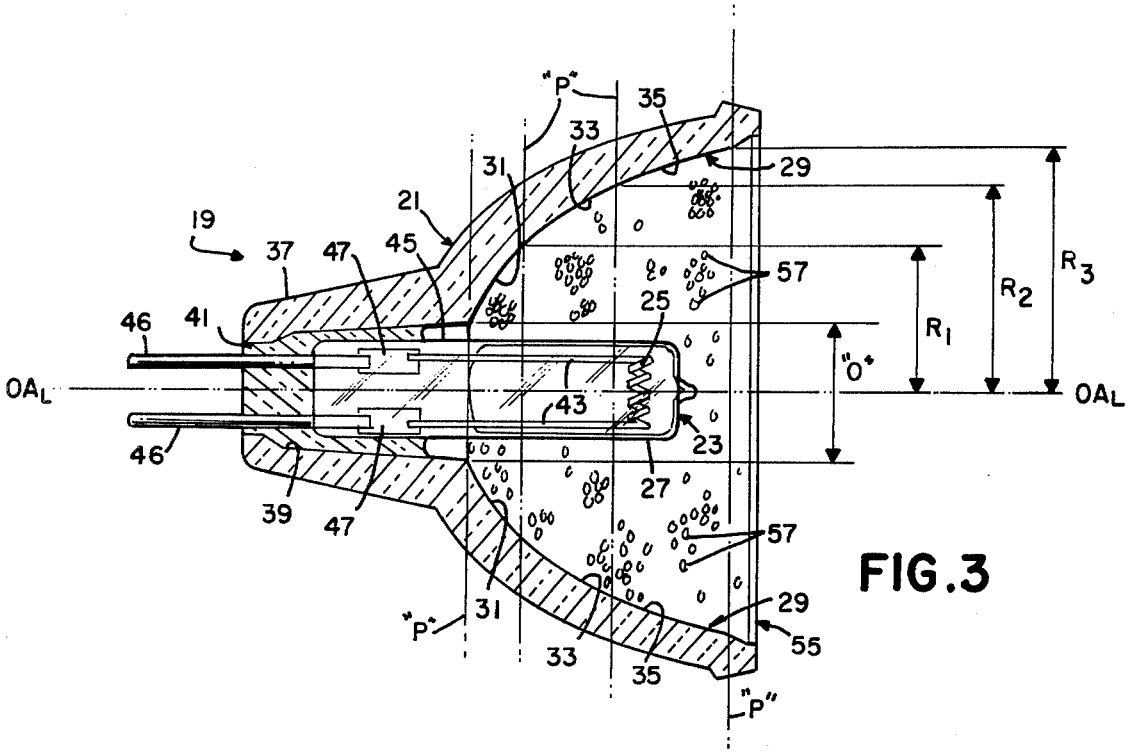
FIG. 3 is a side elevational view, partly in section, of a low voltage lamp unit in accordance with a preferred embodiment of the invention.

As shown in FIG. 3, glass reflector 21 also includes a neck portion 37 adjacent the reflective portion. Portion 37 has an opening 39 therein in which is secured lamp 23 such that the lamp's envelope 27 is oriented within the reflective portion and surrounded by regions 31, 33, and 35. Lamp 23 is secured using a suitable insulative adhesive 41, e.g. sauereisen cement. Each lamp includes the aforedescribed glass envelope 27 having the tungsten filament 25 secured therein. A pair of conductive leads 43 support the filament and are embedded within the press-sealed end 45 of envelope 27. A corresponding pair of conductive pins 46 project from end 45 as well as neck portion 37 and are electrically joined within the press-sealed end to leads 43 via a pair of molybdenum strips 47. In one example of the invention, envelope 27 has an overall length of about 1.14 inch and pins 46 are spaced apart at a distance of about 0.20 inch.

As shown in FIG. 1, a common lead 51 connects a single pin 46 from lamp unit 19 to a corresponding pin 46 of unit 19'. A single lead 53 is connected to the remaining pin 46 in each unit and joined to a respective one of the terminals 17 in base portion 13. The lamps of light 10 are thereby connected in series.

With particular regard to FIG. 3, first diffusing region 31 is shown as being positioned nearer optical axis $OA_L$—$OA_L$ than regions 33 and 35 and occupies the radial distance $R_1$ from the optical axis, exclusive of the annular opening "O" in which is positioned lamp 23. Second diffusing region 33, less diffusing than region 31, is contiguous thereto and occupies an area on surface 29 from the outermost portion of region 31 to the radial distance $R_2$. In other words, region 33 can be represented by the difference $R_2$–$R_1$ in relation to the reflector's optical axis. Similarly, region 35, less diffusing than region 33, is contiguous thereto and can be represented by the difference $R_3$–$R_2$. In one example of the invention, $R_1$ was 0.375 inch, $R_2$ was 0.600 inch, and $R_3$ was 0.841 inch. Opening "O" had a diameter of 0.500 inch.

Figure 3A:
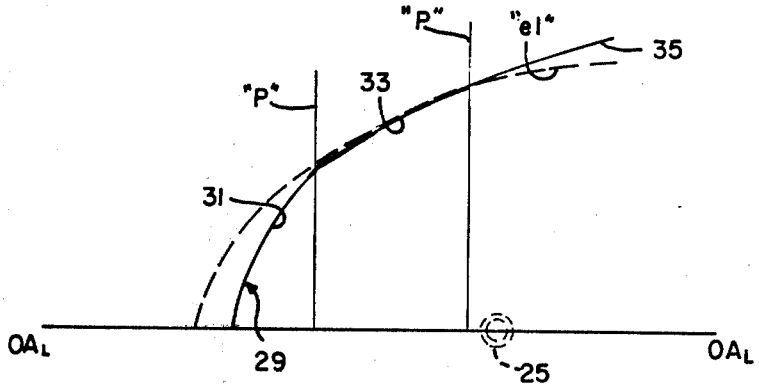
FIG. 3A is a schematic view showing the contour configuration of the reflector of the invention as compared to a typical ellipsoid.

As defined earlier, surface 29 is circular in planes perpendicular to axis $OA_L$—$OA_L$. To provide the described controlled diffusion of light from the unit's lamp, it is preferred that the contours of regions 31, 33, and 35 are different. By contour is meant the radial configuration from the reflector's apex to the forward rim portion 55 in planes passing through the optical axis. In one embodiment of the invention, the contour of second region 33 was ellipsoidal. That is, the configuration represented by $R_2$–$R_1$ was a segment of an ellipsoid which, if extended, would constitute an acceptable configuration for many reflectors utilized in the projection lamp art. Such a configuration is represented in FIG. 3A by the dashed line "el". The contour 29 of reflector 21 is represented by the solid line. Region 33 is shown as following the ellipsoid's contour. Adjoining regions 31 and 35 have been modified, however. First region 31 has been increased in curvature over that of second region 33, thus narrowing the distance between this surface and the light-emitting filament 25 of lamp 23. Filament 25 is shown in phantom in FIG. 3A. The third, outer region 35 is expanded and flattened, e.g., of lesser curvature than region 33. The distance between the surface of region 35 and filament 25 is increased over that of a normal ellipsoid if surface 29 were extended along the line "el".

Each diffusing region comprises a plurality of formed specular "peen" diffusing elements 57 which may be either of concave or convex configuration within surface 29. In a preferred embodiment, elements 57 were of partially spherical configuration. That is, the peening member used to form said elements contained a series of extending spherical members which indented surface 29 a pre-established depth when the glass material of reflector 21 was heated and in a softened condition. The peen elements in each of the three diffusing regions are thereby of similar (spherical) configuration. However, to provide the desired differences in diffusing properties for these regions, the radii of curvature of the elements in region 31 were smaller than those in region 33 while those in region 33 were, in turn, smaller than the radii of curvature of the elements in region 35. As an example, the elements of region 31 were all concave and each possessed a radius of curvature of about 0.095 inch. The elements of region 33 were also concave and each possessed a radius of curvature of about 0.175 inch, while those in region 35 had a radius of curvature of 0.275 inch. The widths (distance across at the widest location) of all of the peen elements formed in accordance with the above schedule were identical, preferably within the range of about 0.030 to 0.050 inch. With particular regard to the invention, it is preferred that the radii of curvature of the spherical peen elements of second region 33 be within the range of about 1.50 to about 2.00 times the radii of curvature of the elements of region 31 while the elements of region 35 have a radii of curvature from about 2.50 to about 3.00 times the radii of curvature of the elements in the first region. As a further example of the invention, region 31 contained approximately 300 peen elements 57, region 33 contained 500 elements, and region 35 contained 1300 elements. It is to be noted that the controlled diffusion is proportional to the quotient of peen width to peen radius of curvature over a reasonable range. Accordingly, the values defined above may vary in accordance with this stated principle without significantly altering performance.

It is preferred in the present invention to include a dichoric coating on surface 29. Coatings of this type are known in the projection lamp reflector art and are used to reflect the lamp's light in the forward direction while permitting a substantial amount of the heat built up within the reflector to pass therethrough. The result is a cooler operating lamp unit which serves to extend the operating life of the lamp as well as reducing the possibility of injury to the system's user. Understandably, such a coating will not alter the aforedescribed peen schedule.

Figure 4:
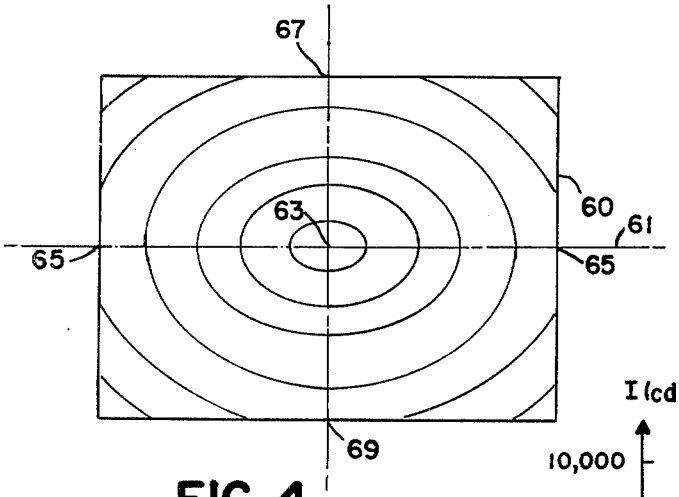
FIG. 4 represents the resulting intensity pattern on a rectangular subject field from a single lamp unit of the invention in which the unit's planar filament is horizontally aligned and the optical axis of the unit's reflector is directed toward the center of the field.
Figure 5:
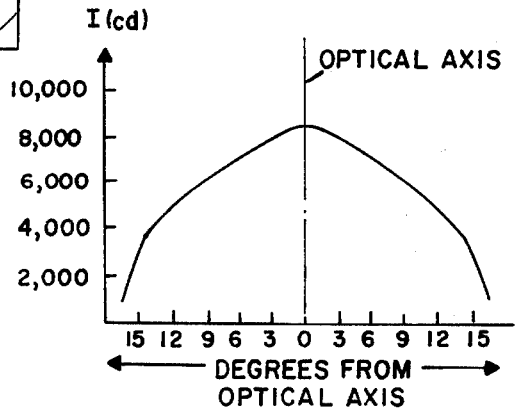
FIG. 5 represents the intensity profile of the subject field of FIG. 4 as taken along a horizontal line through the center of the field.

In FIGs. 4 and 5, there is shown the resulting intensity distribution from one of the lamp units of the invention. The subject field 60 in FIG. 4 is rectangular and of the size and aspect ratio previously described. The intensity profile of FIG. 5 is representative of the intensity readings on field 60 as taken along a horizontal axis 61 through the center of field 60. Understandably, the lamp unit would be oriented in such a manner that the planar filament would also be horizontal and would, therefore, lie on a horizontal plane which passes through axis 61. As shown in FIG. 5, the peak intensity of a single unit is approximately 9200 candelas at the point of intersection between axis 61 and the unit's optical axis $OA_L$—$OA_L$. This point is shown as numeral 63 in FIG. 4. At the outermost edge 65 of the field, as taken along axis 61, the intensity approaches 3000 candelas as the spread angle of the light beam increases. With field 60 at the established distance of about 15 feet from the lamp unit, the half spread angle (from center 63 to point 65) is approximately 12 degrees. Additionally, the uppermost and lowermost edges 67 and 69, respectively, possess intensity values of about 5200 to 6000 candelas. The half spread angle at these points is about 9 degrees.

Figure 6:
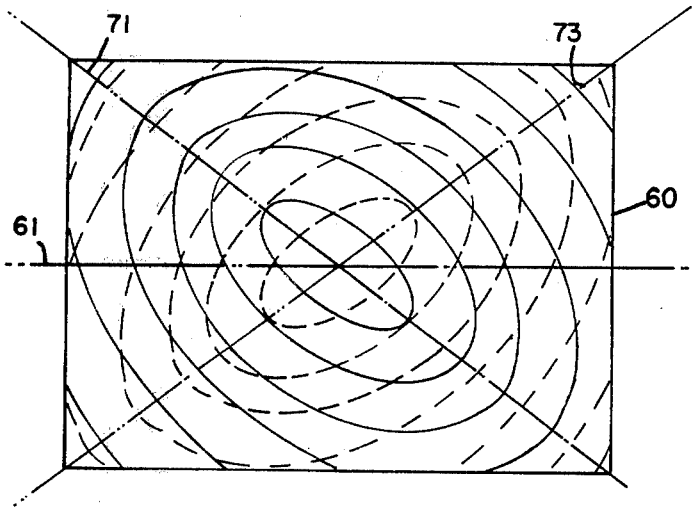
FIG. 6 represents the resulting intensity pattern on a rectangular subject field from the movie light of FIG. 1.

The resulting intensity distribution as produced on rectangular field 60 by movie light 10 is illustrated in FIG. 6. By rotating the lamp units 19 and 19' within light 10 such that the planar filaments are oriented in the predescribed angular relationship, it can be seen that the intensity distribution from each unit centers on a respective one of the diagonals 71 and 73 of field 60. In effect, light 10 is able to pump light into the corners of field 60 in order to provide the aforedefined levels of illumination across the field with minimal light losses externally thereof. For example, the intensity produced by one embodiment of the invention at the center of field 60 was within the range of about 14,500 to about 17,000 candelas, while the intensity readings at the corners of the field ranged from about 5000 to about 7500 candelas. Of added significance, the resulting angularly oriented intensity contours are each broad enough such that allowance is provided for minor misalignment of the lamp units of the invention without causing major variations in the corner illumination levels. The above advantages are considered particularly useful because each of the lamp units produce intensity profiles which have relatively high gradients at the edge of the field. The end result, therefore, is a maximization of the light level on subject field 60. Lamp units and movie lights of the prior art have heretofore been unable to provide these unique capabilities.

Thus, there has been illustrated and described a unique movie light system capable of illuminating a distant subject field with greater levels of uniformity than many known systems. As defined, this system is compact, easy to operate, and inexpensive to replace. It is also readily adaptable to many motion picture cameras, particularly the aforedescribed "instant movie" system. Still further, the invention as defined does not require a lens or series of lenses in order to assure the described light output. This further reduces the cost of the present invention in comparison to systems of the prior art.

While there have been shown and described what are at present considered the preferred embodiments of the invention, it will be obvious to those skilled in the art that various changes and modifications may be made therein without departing from the scope of the invention as defined by the appended claims. For example, a fuse may be placed in the light's circuitry, e.g., across common lead 51, to provide a safety feature. It is also desirable to utilize a plastic transparent protective member (not shown) in front of each unit. Such a member will have a minimal attenuating effect on the light output but out in an adverse sense.

What is claimed is:

1. A reflector for providing controlled diffusion of light, said reflector including a concave, internal diffusing surface having first, second, and third individual diffusing regions, each located about the optical axis of said reflector, said first region being positioned nearer said optical axis than said second and third regions, said second region being less diffuse than said first region and positioned contiguous thereto, and said third region being less diffuse than said second region and positioned contiguous thereto.

2. The reflector according to claim 1 wherein the contour of said second diffusing region is of ellipsoidal configuration.

3. The reflector according to claim 2 wherein the contour of said first diffusing region is of non-ellipsoidal configuration having a greater curvature than said second diffusing region.

4. The reflector according to claim 3 wherein the contour of said third diffusing region is of non-ellipsoidal configuration having a lesser curvature than said second diffusing region.

5. The reflector according to claim 1 wherein each of said diffusing regions comprises a plurality of substantially similar peen elements arranged therein an established pattern, each of said peen elements of partially spherical configuration.

6. The reflector according to claim 5 wherein the radii of curvature of said peen elements of said second region are within the range of about 1.50 to about 2.00 times the radii of curvature of said peen elements of said first region and the radii of curvature of said peen elements of said third region are within the range of about 2.50 to about 3.00 times the radii of curvature of said peen elements of said first region.

7. The reflector according to claim 1 wherein said reflector is comprised of borosilicate glass.

8. The reflector according to claim 7 wherein said concave, internal surface of said reflector includes a dichoric coating thereon.

9. A lamp unit for providing a controlled, diffuse beam of light, said unit comprising:

a reflector including a concave, internal diffusing surface having first, second, and third individual diffusing regions, each located about the optical axis of said reflector, said first region being positioned nearer said optical axis than said second and third regions, said second region being less diffuse than said first region and positioned contiguous thereto, said third region being less diffuse than said second region and positioned contiguous thereto; and a low-voltage incandescent lamp positioned within said reflector, said lamp including a light-transmitting envelope substantially surrounded by said concave, internal diffusing surface of said reflector and a substantially planar, single filament supported within said envelope.

10. The lamp unit according to claim 9 wherein the contour of said second diffusing region is of ellipsoidal configuration, the contour of said first diffusing region is on non-ellipsoidal configuration having a greater curvature than said second diffusing region, and the contour of said third diffusing region is of non-ellipsoidal configuration having a lesser curvature than said second diffusing region.

11. The lamp unit according to claim 9 wherein each of said diffusing regions comprises a plurality of substantially similar peen elements arranged therein in an established pattern, each of said peen elements of partially spherical configuration.

12. The lamp unit according to claim 11 wherein the radii of curvature of said peen elements of said second region are within the range of about 1.50 to about 2.00 times the radii of curvature of said peen elements of said first region and the radii of curvature of said peen elements of said third region are within the range of about 2.50 to about 3.00 times the radii of curvature of said peen elements of said first region.

13. The lamp unit according to claim 9 wherein said incandescent lamp is a tungsten-halogen lamp.

14. The lamp unit according to claim 13 wherein said planar filament comprises a straight, helical coiled member.

15. The lamp unit according to claim 14 wherein said straight helical-coiled member is transversely oriented on said optical axis of said reflector.

16. The lamp unit according to claim 9 wherein said lamp unit is a movie light.

17. A movie light comprising:

a holder adapted for being mounted on a movie camera;

first and second spaced-apart lamp units positioned within said holder, each of said lamp units having a reflector including a concave, internal diffusing surface having first, second, and third individual diffusing regions, each located about the optical axis of said reflector, said first region being positioned nearer said optical axis than said second and third regions, said second region being less diffuse than said first region and positioned contiguous thereto, said third region being less diffuse than said second region and positioned contiguous thereto, and a low voltage incandescent lamp positioned within said reflector, said lamp including a light-transmitting envelope substantially surrounded by said concave, internal diffusing surface of said reflector and a substantially planar, single filament supported within said envelope, the plane of said filament of said first lamp unit intersecting the plane of said filament of said second lamp unit at a predetermined angle; and means for electrically connecting said first and second lamp units to an external power source.

18. The movie light according to claim 17 wherein the contour of said second diffusing region of said reflector is of ellipsoidal configuration, the contour of said first diffusing region is of non-ellipsoidal configuration having a greater curvature than said second diffusing region, and the contour of said third diffusing region is of non-ellipsodial configuration having a lesser curvature than said second diffusing region.

19. The movie light according to claim 17 wherein each of said diffusing regions comprises a plurality of substantially similar peen elements arranged therein an established pattern, each of said peen elements of partially spherial configuration.

20. The movie light according to claim 19 wherein the radii of curvature of said peen elements of said second region are within the range of about 1.50 to about 2.00 times the radii of curvature of said peen elements of said first region and the radii of curvature of said peen elements of said third region are within the range of about 2.50 to about 3.00 times the radii of curvature of said peen elements of said first region.

21. The movie light according to claim 17 wherein each of said incandescent lamps is a tungsten-halogen lamp and each of said planar filaments comprises a straight, helical-coiled member.

22. The movie light according to claim 17 wherein said predetermined angle of intersection between said planes of said filaments is within the range of from about 90 to about 110 degrees.

23. The movie light according to claim 17 wherein said planes of said filaments intersect at a point below the optical axis of said movie light.

24. The movie light according to claim 17 wherein said electrical connecting means comprises a pair of terminals projecting from said housing and adapted for being electrically joined to said external power source.

25. The movie light according to claim 17 wherein said movie light substantially uniformly illuminates a rectangular subject field located at a pre-established distance from said movie light, each of said lamp units producing an intensity distribution which is centrally oriented on a respective one of the diagonals of said subject field.

26. The movie light according to claim 25 wherein said subject field has an aspect ratio of approximately 3:4.

* * * * *